United States Patent [19]

Pelagio et al.

[11] 4,237,685

[45] Dec. 9, 1980

[54] APPARATUS FOR PRODUCING A YARN

[75] Inventors: Gregory A. Pelagio, Swansea; Wiley B. Holland, North Attleboro, both of Mass.

[73] Assignee: Owens-Corning Fiberglas Corporation, Toledo, Ohio

[21] Appl. No.: 25,156

[22] Filed: Mar. 29, 1979

[51] Int. Cl.[3] ..... D01H 5/28; D01H 5/30

[52] U.S. Cl. ..... 57/328; 19/0.56; 19/150; 57/249

[58] Field of Search ..... 57/328–331, 57/249, 240; 19/0.3, 0.46, 0.51, 0.56, 0.58, 150, 157, 236

[56] References Cited

U.S. PATENT DOCUMENTS

| | | | |
|---|---|---|---|
| 1,616,015 | 2/1927 | Wenzel | 57/328 |
| 2,133,238 | 10/1938 | Slayter et al. | 57/249 X |
| 2,314,857 | 3/1943 | Tucker et al. | 19/150 X |
| 2,323,684 | 7/1943 | Simison | 57/249 X |
| 2,363,470 | 11/1944 | Lannan et al. | 19/150 |
| 2,411,326 | 11/1946 | McMillin et al. | 19/150 X |
| 3,033,719 | 5/1962 | Marzocchi et al. | 57/249 X |
| 3,161,920 | 12/1964 | Stalego | 19/0.51 |
| 3,264,811 | 8/1966 | Heathcote | 57/328 |
| 3,307,344 | 3/1967 | Southard, Jr. | 57/328 X |
| 3,855,772 | 12/1974 | Burlet | 57/328 X |

*Primary Examiner*—John Petrakes

*Attorney, Agent, or Firm*—Ronald C. Hudgens; Philip R. Cloutier; Greg Dziegielewski

[57] ABSTRACT

Method and apparatus are provided for producing a yarn comprising; supplying a web of staple fibers to a first region; forming said web into a bundle at a zone intermediate said first region and an after-defined second region; tensioning said fibers at a second region to draft said bundle into a yarn advancing at a predetermined rate; and collecting said yarn at a third region at a rate substantially equal to said predetermined rate of advancement.

3 Claims, 2 Drawing Figures

APPARATUS FOR PRODUCING A YARN

BACKGROUND OF THE INVENTION

Systems for producing a yarn of staple glass filaments wherein streams of molten glass attenuated by the action of jets of steam or air are collected on a rotatable foraminous drum and subsequently shaped and drafted into a yarn to be ultimately wound as a package are well known in the art. For example, see U.S. Pat. No. 2,133,238 issued to G. Slayter et al on Oct. 11, 1938.

One of the limiting factors in the throughput in such a system is that commercially available winders are generally not adapted to tension the yarn sufficiently to draft the web of fibers into a yarn while maintaining proper package build.

SUMMARY OF THE INVENTION

Method and apparatus are provided for supplying a web of staple fibers to a first region, forming said web into a bundle at a zone intermediate said first region and an after-defined second region, tensioning said fibers at a second region to draft said bundle into a yarn advancing at a predetermined rate, and collecting said yarn at a third region spaced from said second region at a rate substantially equal to said predetermined rate of advancement of said yarn.

It is an object of this invention to provide an improved system for forming a yarn of staple fibers.

The foregoing, as well as other objects of the present invention, will become apparent to those skilled in the art from the following detailed description.

DESCRIPTION OF THE INVENTION

Figure 1:
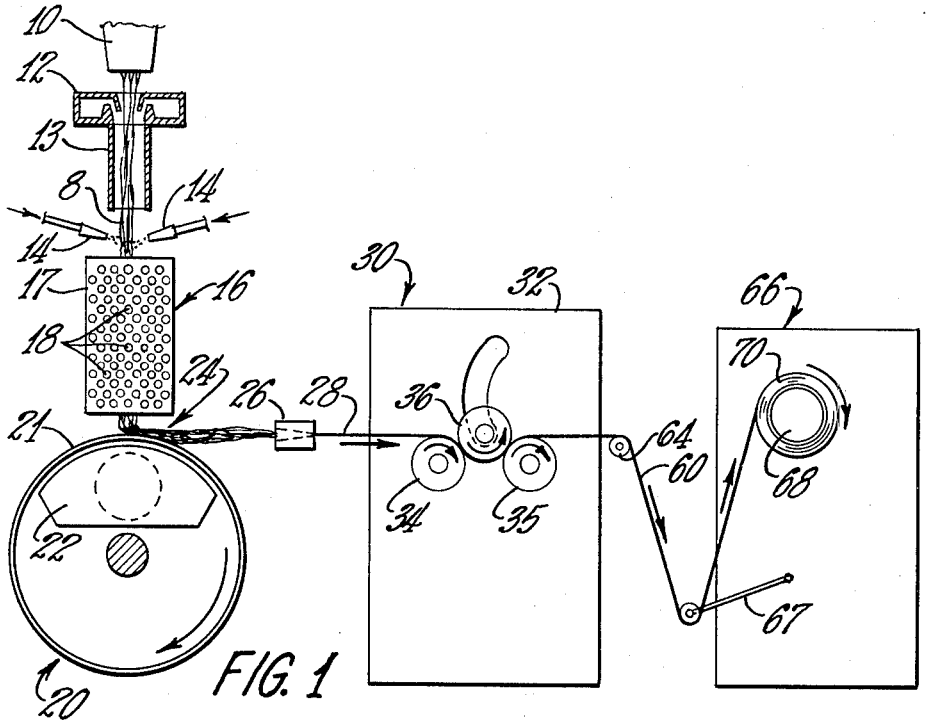
FIG. 1 is a semi-schematic front view of a staple yarn production system according to the principles of this invention.

As shown in FIG. 1, staple filaments 8 are produced by attenuating streams of molten material issuing from feeder 10 by means of blower assembly or attenuation means 12. The fibers can be of any suitable material such as glass or polymeric resin and can be produced by any other system capable of delivering a web of staple fibers.

Blower assembly 12 directs streams of gaseous blasts along the length of the streams or filaments at velocities sufficient to attenuate the streams into staple filaments 8, as is known in the art.

Preferably, blower 12 is of the type having a skirt 13 depending therefrom to enhance and control the attenuation forces. Also, blower 12 should be adjustable along the path of advancement of the filaments, and the orifice through which the filaments pass should be adjustable in size, preferably with respect to the width thereof, for improved control of the process.

As the filaments 8 emerge from blower 12, a liquid sizing and/or binder can be applied to the filaments by means of nozzles 14.

Downstream of the blower 12, a foraminous guide 16 which is comprised of a shell 17 having a plurality of apertures 18 therein, is adapted to dissipate the attenuating gases while retaining the staple filaments within guide 16. As such, the diameter of the apertures 18 should be substantially less than the length of the individual staple filaments 8, and guide 16 should be placed close enough to the vacuum section 22 of drum 20 to induce air inwardly through the apertures 18 at the exit region of guide 16.

As the staple filaments 8 emerge from the foraminous guide 16, the filaments 8 are collected upon a first collection means or drum 20 located in a first region. Drum 20 is comprised of a foraminous, circumferential surface 21 which is rotatably driven as is known in the art. Adjacent the exit of the foraminous guide 16 vacuum section 22 within drum 20 provides an inward flow of air through surface 21 to retain the individual filaments on surface 21, as is known in the art. As such, the individual filaments 8 form a web of inter-entangled filaments 24.

Web 24 then advances through a compacting or twisting means 26 at a zone spaced from the first region. Shaping or compacting means 26 is comprised of a hollow shaft through which the filaments 8 pass while the shaft is rotated at high speed. In forming systems wherein the drum rotates at a surface speed of approximately 400 feet per minute and the yarn is advancing at approximately 800 feet per minute, the compacting means is driven at approximately 3,700 rpm.

Web 24 emerges from the compacting means as a bundle of filaments 28 which is being advanced by means of drafting or tensioning means 30 at a second region. According to this invention, the web 24 is drafted into a yarn at a ratio of approximately 2.4:1. That is, the length of the yarn 60 is approximately 2.4 times that of the associated unit of web 24.

Drafting means 30 is comprised of a housing 32 and a plurality of driven, rotatable pull rolls which apply tension to bundle 28 sufficient to advance and draft web 24 and/or bundle 28 into yarn 60.

Figure 2:
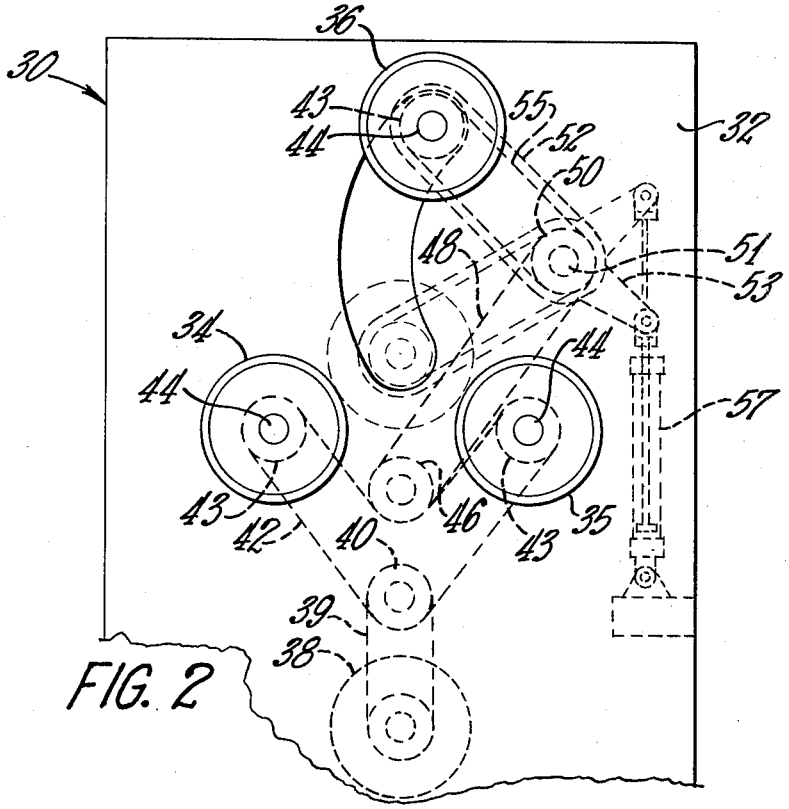
FIG. 2 is a front view of the drafting means shown in FIG. 1.

As shown in FIGS. 1 and 2, second pull roll 34 is rotatably journaled in housing 32 as is third pull roll 35. Pull rolls 34 and 35 each have a fixed axis of rotation and are spaced from each other. First, rotatable pull roll 36 is adapated for relative lateral movement with respect to pull rolls 34 and 35.

During start-up, moveable pull roll 36 is moved out of engagement with pull rolls 34 and 35 to facilitate the threading of bundle 28 through the drafting means 30. Once the operator is satisfied that the system is ready to begin production, the moveable pull roll 36 is moved to engage pull rolls 34 and 35 with bundle 28 therebetween. Pull rolls 34, 35, and 36 are synchronously driven at a predetermined rate or speed sufficient to draft the filaments into the yarn desired.

Pull rolls 34, 35, and 36 are driven by means of motor 38 which is connected to the first dual pulley 40 by a first drive belt 39. Second belt 42 engages first dual pulley 40 and pulleys 43 of pull rolls 34 and 35, as well as second dual pulley 46. Pulleys 43 are rotatably journaled on shafts 44 which can be suitably mounted on housing 32.

Third drive belt 48 engages second dual pulley 46 and third dual pulley 50. Third dual pulley 50 is rotatably journaled on shaft 51 which is mounted on housing 32.

Arm 52 is rotatably journaled on shaft 51, and third pull roll 36 is rotatably journaled at the opposite end of arm 52 on shaft 44 which is mounted on arm 52. Fourth drive belt 55 engages pulley 43 of pull roll 36 and third dual pulley 50 to drive pull rolls 34, 35, and 36 at substantially the same speed.

Arm 52 is adapted to pivot about shaft 51 to move third pull roll 36 along an arcuate path. However, it is to be understood that pull roll 36 need not be restricted to moving only along an arcuate path.

Extension 53 is suitably coupled with motive means, such as a dual acting air cylinder, 57 to pivot or move pull roll 36 at predetermined times. The body of cylinder 57 can be suitably attached to housing 32. Air cylinder 57 is connected to a suitable supply of pressurized air (not shown) which can be controlled by conventional valve means by the operator to raise and lower moveable pull roll 36 as desired.

Subsequent to drafting means 30, yarn 60 passes over guide roll 64 and under tension arm 67 of winder 66 to be wound as a package 70 upon collet 68 at a third region spaced from drafting means 30. Winder 66 can be of the commercially available type, such as a Leesona 959 winder.

According to the principles of this invention, staple yarns of glass fibers can be produced at rates of about 25 pounds per hour at velocities of about 200 to 1,000 feet per minute.

It is apparent within the scope of the invention, modifications and different arrangements can be made other than as herein disclosed. The present disclosures are merely illustrative, with the invention comprehending all variations thereof.

We claim:

1. Apparatus for producing a yarn comprising:

feeder means for supplying a plurality of streams of molten glass;

attenuation means for transforming said streams into staple filaments;

means for collecting said staple filaments as a web at a first region;

first means for forming said web into a strand-like bundle of fibers at a second region;

second means for drafting said web and bundle of fibers into said yarn, said second means having (a) a first pull roll having a movable axis of rotation, (b) a second pull roll, and (c) a third pull roll spaced from said second pull roll, said first pull roll being adapted to substantially simultaneously engage said second and third pull rolls when said first pull roll is moved towards said second and third pull rolls to advance the yarn therebetween to draft said web and bundle; and third means for collecting said yarn as a wound package, said first, second and third means being spaced from each other.

2. The apparatus of claim 1 further comprising a means for synchronously driving said first, second and third pull rolls comprising: a motive means connected with a first dual pulley by a first drive belt; a second drive belt adapted to engage said first dual pulley, first and second pulleys of said second and third pull rolls; and a second dual pulley; a third drive belt adapted to engage said second dual pulley and third dual pulley, said third dual pulley being rotatably journaled on a shaft, an arm rotatably journaled on said shaft; said third pull roll being rotatably journaled on said arm at an end opposite said shaft; and a fourth drive belt adapted to engage said third dual pulley to drive said first pull roll synchronously with said second and third pull rolls.

3. The apparatus of claim 2 further comprising a second motive means adapted to move said arm at a predetermined time.

* * * * *